US005613879A

United States Patent [19]

Fonteneau et al.

[11] Patent Number: 5,613,879

[45] Date of Patent: Mar. 25, 1997

[54] COUPLING CONNECTOR TO A COMPLEMENTARY PLUG UNIT

[75] Inventors: Michel Fonteneau, Le Mans; Michel Pesson, Sille Le Philippe, both of France

[73] Assignee: Framatome Connectors International, Paris, France

[21] Appl. No.: 438,250

[22] Filed: May 10, 1995

[30] Foreign Application Priority Data

May 11, 1994 [FR] France ..... 94 05801

[51] Int. Cl.[6] ..... H01R 13/648

[52] U.S. Cl. ..... 439/607

[58] Field of Search ..... 439/607, 608, 439/609, 610, 108, 79, 89, 82, 83

[56] References Cited

U.S. PATENT DOCUMENTS

| | | | |
|---|---|---|---|
| 4,512,618 | 4/1985 | Kumar | 339/14 R |
| 4,943,244 | 7/1990 | Teck et al. | 439/607 |
| 5,104,326 | 4/1992 | Smith et al. | 439/79 |
| 5,147,220 | 9/1992 | Lybrand | 439/607 |
| 5,163,851 | 11/1992 | Hart et al. | 439/607 |
| 5,252,080 | 10/1993 | Pesson | 439/82 |

FOREIGN PATENT DOCUMENTS 0546884 6/1993 European Pat. Off. .

*Primary Examiner*—Neil Abrams
*Assistant Examiner*—Yong Kim
*Attorney, Agent, or Firm*—Perman & Green

[57] ABSTRACT

The present invention has for a subject a coupling connector of the type having a front insulating block (3); elbow electrical contact elements (5) having front contact regions (50) lodged in openings made in the front insulating block, as well as regions forming elbows and rear contact terminations (55); a rear insulating block (2), rear insulating block (2) having a central regions (20) and two lateral branches (21, 22); and a front box (4) for shielding and connection with a connector or complementary plug unit. According to the invention, tabs (42, 43) or similar components are provided, arranged peripherally on front box (4) and anchoring groves made peripherally on rear (2) and front (3) insulating blocks, so as to join them with front box (4), by a crimping operation.

10 Claims, 3 Drawing Sheets

COUPLING CONNECTOR TO A COMPLEMENTARY PLUG UNIT

BACKGROUND OF THE INVENTION

The present invention has for a subject a coupling connector of the type having a front insulating block; elbow electrical contact elements having front contact regions and housed in openings made in the front insulating block, as well as regions forming elbows and rear contact terminations; a rear insulating block, said insulating block having a central region and two lateral branches; and a front shielding and connection box with a complementary connector or plug unit.

This type of coupling connector is designed to be attached onto a support plate, and more particularly onto a printed circuit board. The rear contact terminations are inserted by force in holes made in said board.

During the forced insertion of the terminations, various forces are exerted, in the first place on the terminations, but also on the rear insulating block, and finally on the front insulating block.

These undesirable forces can be translated, on the one hand, by the separation of the front and rear insulating blocks, and on the other hand, by the deformation of contacts, if they are poorly held and/or guided, due to this separation. There is especially a risk of deformation of the contact pin during the insertion operation from which results a poor connection.

Different coupling connectors of the above mentioned type are known. French patent FR-B-2,684,810 (SOURIAU AND CO. S.A.) describes a connector in which is used a rear insulator having grooves defining upper, rear and lateral support surfaces for the contact pins. This insulator is ratcheted with vertical play in the grooves made in the front insulator.

The contacts are forcefully pre-inserted or molded into the insulating support contacts (i.e. front insulator), then bent, the positioning of the rear insulator being the last operation effected on the contact before delivery.

However, there is a risk of detaching the insulators during the forced insertion of the contacts into the printed circuit, the insertion force being typically raised to 10 N per contact.

U.S. Pat. No. 4,512,618 (AMP Inc.) describes a connector made up of a one-piece insulator in which the contacts are held. This one-piece insulator supports on its front part a shielding screen extended by means of at least one ground contact clip permitting electrical continuity between the connection surface to a complementary connector and the printed circuit.

Nevertheless, the problem previously mentioned, which has been linked to the forceful insertion of the contacts, has not been resolved. However, this is not the subject to which this invention pertains; the objective is rather to furnish a shielding screen. It cannot anticipate that this shield can participate in the solution of the problem posed and, notably, that this shield can offer a sufficient rigidity to keep the front and rear insulators of the connector joined together in one piece during the forceful insertion of contacts into the printed circuit.

SUMMARY OF THE INVENTION

The invention seeks to eliminate the disadvantages of the devices of the prior art, certain of which have just been mentioned.

To do this, contrary to the configurations adopted for devices of the prior art, which have just been mentioned, the front box is of one piece with the rear insulating block, so as to tightly hold the front insulating block, i.e., the insulating block bearing the contact.

In a preferential manner, the front box is joined to the rear insulating block by crimping. This operation, simple to realize, does not appreciably increase the manufacturing cost or the complexity.

In a preferred variant of embodiment, the front box is also joined with the front insulating block in a similar manner.

The invention therefore has for a subject a coupling connector of the type comprising a front insulating block; elbow electrical contact elements having front contact regions lodged in openings made in said front insulating block, as well as regions forming elbows and rear contact terminations; a rear insulating block, said rear insulating block having a central region and two lateral branches; and a front shielding and connection box with a complementary connector or plug unit, characterized in that at least said front box and rear insulating block are provided with complementary attachment means so as to be able to join them by a crimping operation.

BRIEF DESCRIPTION OF THE DRAWINGS

The invention will be better understood and other characteristics and advantages will appear upon reading the description that follows in reference to the attached figures, and among which.

DETAILED DESCRIPTION OF THE DRAWINGS

Figure 1:
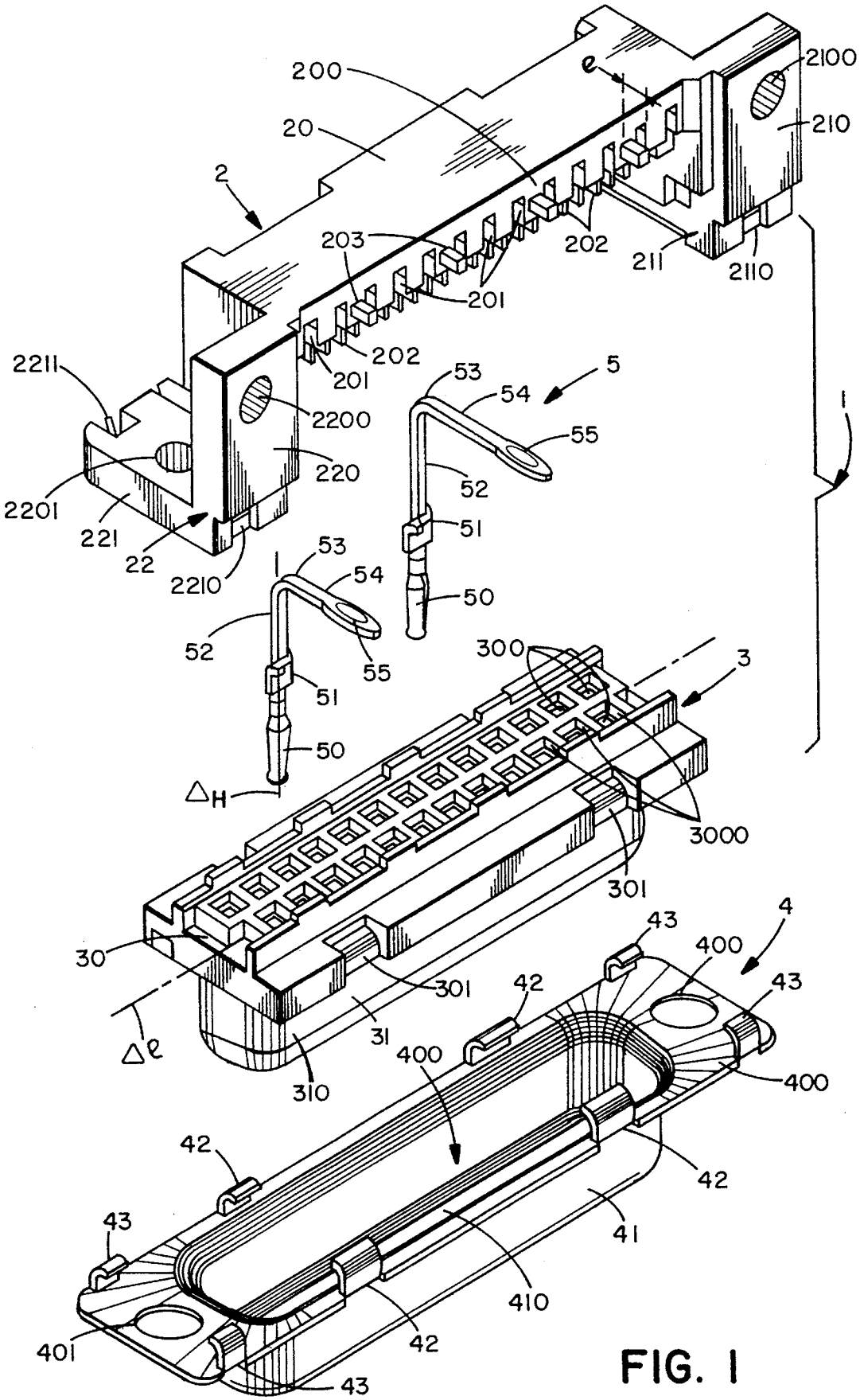
FIG. 1 illustrates an exploded view of one, example of embodiment of a coupling connector according to the invention.

FIG. 1 represents, in an exploded view, an example of embodiment of a coupling connector 1 according to the invention. This coupling connector 1 presents parts in common with the prior art, and notably a rear insulating block 2, elbow electrical contact guides 5, a front insulating block 3 carrying the contacts, and a front shielding box 4.

Rear insulating block 2 has a central zone 20 and two wings, 21 and 22. The surfaces of these wings designed to rest on a printed circuit board (not shown) are referenced as 210 and 220. They are shown in vertical position in the example illustrated. In the following, in a purely arbitrary manner, they will be called "rear" surfaces. They are advantageously provided with openings, 2100 and 2200, designed to allow the free passage of attachment elements (not shown) of coupling connector 1, and more precisely of rear insulating block 2, onto said printed circuit board. This can be done classically by means of screws, rivets, etc.

In the example illustrated in FIG. 1, the "rear" surface of rear insulating block 2 (shown in the vertical position) is always found behind "rear" surfaces 210 and 220, wings 21 and 22. Insulating block 2 is furnished, in its central zone 20, with longitudinal grooves, 201 and 202, serving as guides for electrical connection elements 5. In a more precise manner, elbow parts 53 and all or part of rear terminations 54 and 54 slide on here. In the example illustrated, it is supposed, without this limiting the scope of the invention in any way, that the coupling connector has two rows of electrical connection elements. Grooves 201 and 202 are thus alternated, in the sense that they have a first and a second depth. We will call, throughout the following, the row of grooves of shallowest depth the "upper" row, and the other row the "lower" row.

For purposes of simplification of the figure, we only show two contact elements 5. The double row arrangement of the contacts requires that rear terminations 54, of a first series, are shorter than the rear terminations 54' of the second series.

In an advantageous manner, "rear" surface 200 of central zone 20 of insulating block 2 has cross-pieces 203 whose length 1 is equal to a distance such that it rests on the printed circuit board (not shown). These cross pieces are positioned between two grooves 201 of the upper row. Their number is in general less than the number of grooves composing this row. In the example illustrated, one cross-piece is provided for every three grooves, except at the end (one for two).

The electrical connection elements have three principal regions: a first linear region 52, having contacts 50 at the end, called "front", and an enlarged part 51; an elbow region 53; and a termination region, 54 or 54' called "rear". The end of this latter region has enlarged contact points 55. These are the regions which will be forcefully inserted into openings made in the printed circuit board (not shown).

In the example illustrated, "front" contacts 50 are female contacts. However, male contacts could also be used.

Enlarged part 51 of said first linear zone advantageously has a flattened form and is roughly rectangular, for reasons which will be explained below.

Insulating block 3 has a unit 30, or "upper" part (in FIG. 1), furnished with transverse openings 300. These openings are positioned in a parallel fashion to longitudinal axis $\Delta_L$ of rear insulating block 3 and pierce through unit 30 following an axis $\Delta_H$, orthogonal to longitudinal axis $\Delta_L$. In a more precise manner, they are arranged in staggered rows, the number of openings of one row being usually smaller than that of the other row. This arrangement is linked to the generally asymmetric form of the box which serves as the corrector. Each opening 300 receives one of the contact elements 5. It is therefore necessary that its dimensions are determined so that it allows the free passage of contacts 50, of roughly circular section (in the example illustrated). In contrast, in the zone level with the upper surface (in FIG. 1), sockets 3000 are provided, of roughly rectangular section. Their dimensions are adapted to the dimensions of enlarged parts 51 of contact elements 5. This arrangement prevents the contact elements from turning in their lodging, once they are inserted.

"Lower" part 31 (in FIG. 1) of insulating block 3 is given a rounded profile and a planar "lower" surface 310 with which the ends of contacts 50 are flush.

Finally, a front metal box 4 is provided serving for shielding. It has a planar support 40 pierced with a central opening 400 through which is engaged front insulating block 3, or more exactly, "lower" part 31 of this block. Planar support 40 is extended by a peripheral skirt 41 designed to envelop said "lower" part 31. This skirt 41 is itself pierced with an opening 410 in its bottom, adapted to the dimensions of planar surface 310.

The arrangement which has just been described is for the most part common to those for devices of the prior art.

According to the invention, arrangements are provided to reinforce, on the one hand, the grip of front insulating block 3 and rear insulating block 2 during forceful insertion of terminations 54–55 or 54'–55, and on the other hand, to permit preventing the deformation of contact elements 5 during this same operation.

To do this, anchoring grooves or similar components are provided, on the one hand in front insulating block 3, grooves 301, and on the other hand, in the rear insulating block: grooves 2210, 2211 and 2110. In a more precise manner, with regard to front insulating block 3, these grooves are realized peripherally, on the length of unit 30 (in the example shown). In the same way, the grooves associated with rear insulating block 2 are realized in zones 221 and 221 designed to rest on the printed circuit board (not shown) of lateral wings 21 and 22. It is necessary to understand that, although only grooves 2210, 2110 and 301 are represented, grooves are provided in the corresponding parts of insulating blocks 2 and 3 not visible in FIG. 1.

On front box 4 is also provided, also peripherally, an equal number of tabs or similar components. A first series of tabs, 42, is designed, during the assembly of the pieces making up coupling connector 1, to be slid into grooves 301 of front insulating block 3 and a second series of tabs 43, are designed to be slid into grooves 2210, 2211, 2110. Then, the assembly of pieces making up coupling connector 1 is fixed by crimping, while pressing tabs 42 and 43 down into their respective lodgings: 301 and 2210, 2211, 2110.

It is easily observed that the arrangements which have just been described do not lead to increasing complexity, nor to notable cost increase in the manufacturing process. Only one crimping operation is necessary, this operation substituting for other analogous assembly operations in the case of devices of the prior art.

To complete the description, we will now describe in a more detailed manner the principal assembly operations of different constituents of coupling connector 1 according to the invention, with reference to FIGS. 2*a*, 2*b*, 3*a* and 3*b*. In the following, elements identical to those already described have the same references and will not be described again unless necessary.

Figure 2A:
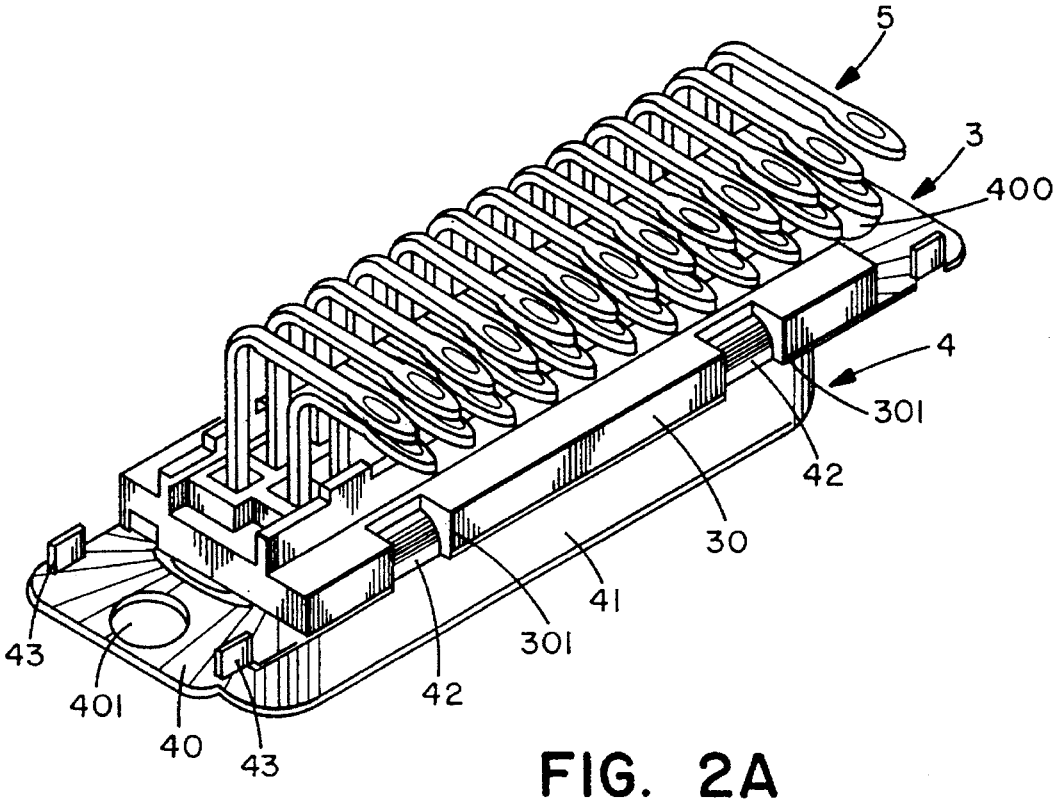
FIG. 2*a* and 2*b* illustrate the mounting of the front box on the front insulating block, respectively, in top three-quarter view and bottom three-quarter view.
Figure 2B:
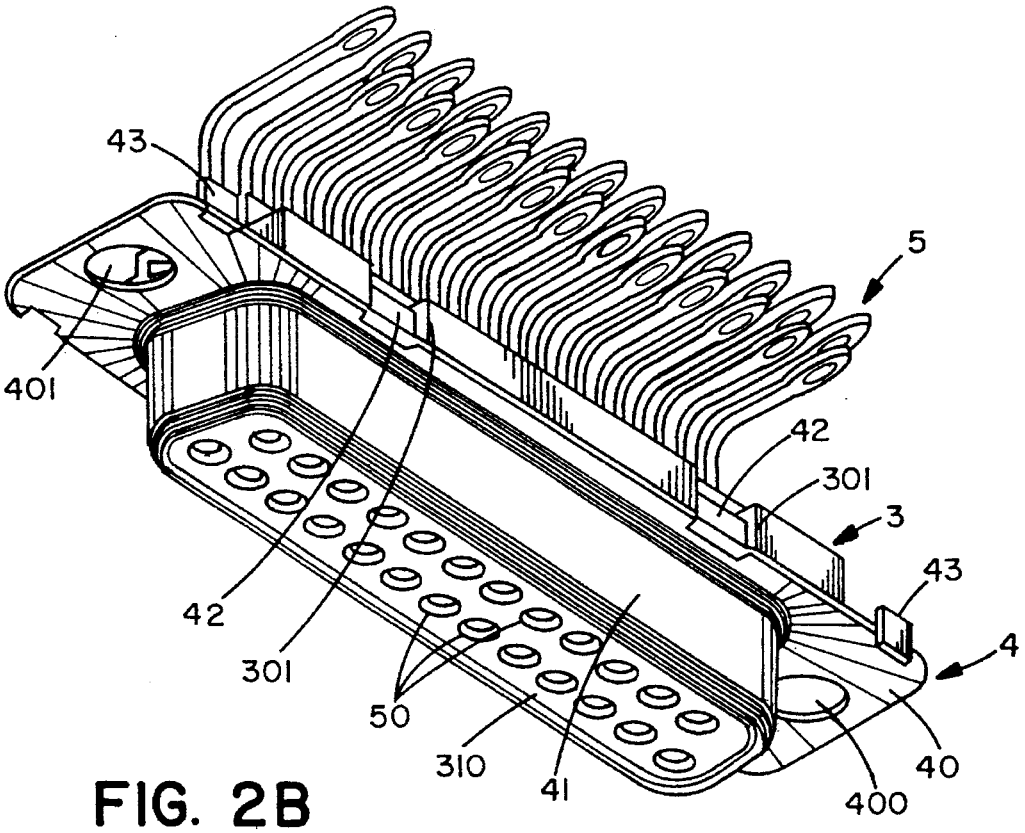

FIGS. 2*a* and 2*b* illustrate the mounting of front box 4 on front insulating block 3, respectively in top three-quarter view and bottom three-quarter view. It is supposed that the insertion operation of contact elements 5, entirely common to the known art, has already been realized. The assembly thus made up, front insulating block 3 and contact elements 5, is engaged in the receptacle which makes up front box 4. Then, tabs 42 are pushed down into grooves 301. This operation permits joining the box to said assembly.

Figure 3A:
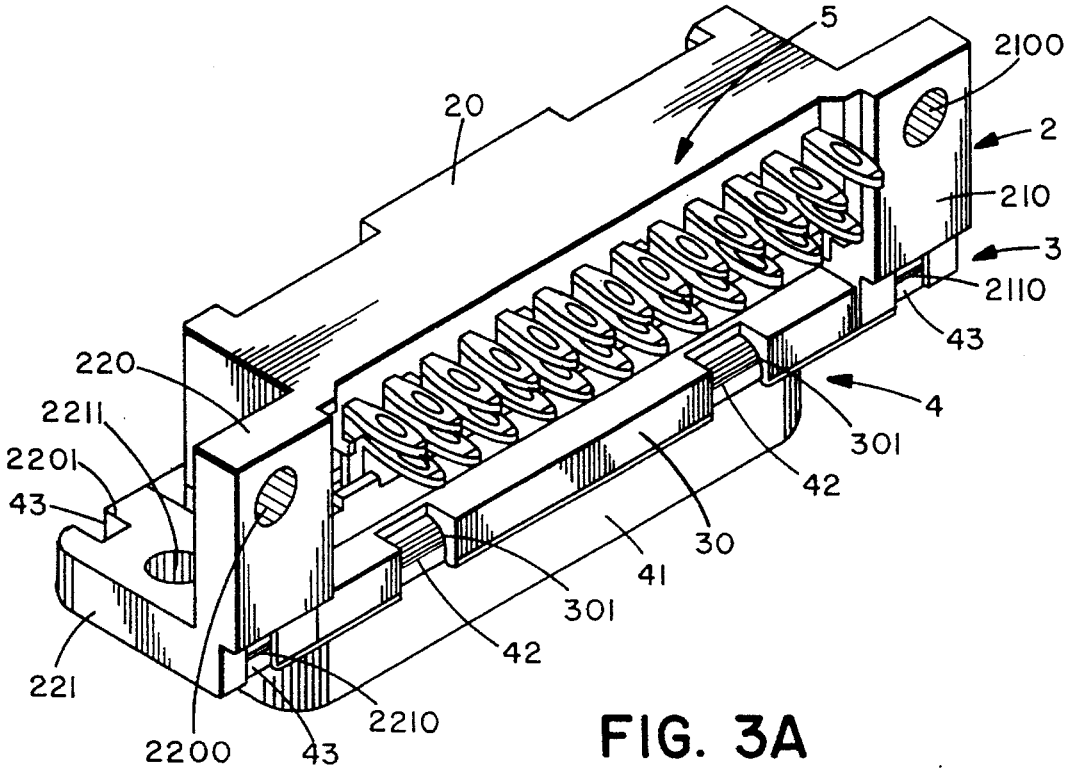
FIG. 3*a* and 3*b* illustrate the final coupling of the front box and the front insulating block on the rear insulating block, respectively, in top three-quarter view and bottom three-quarter view.
Figure 3B:
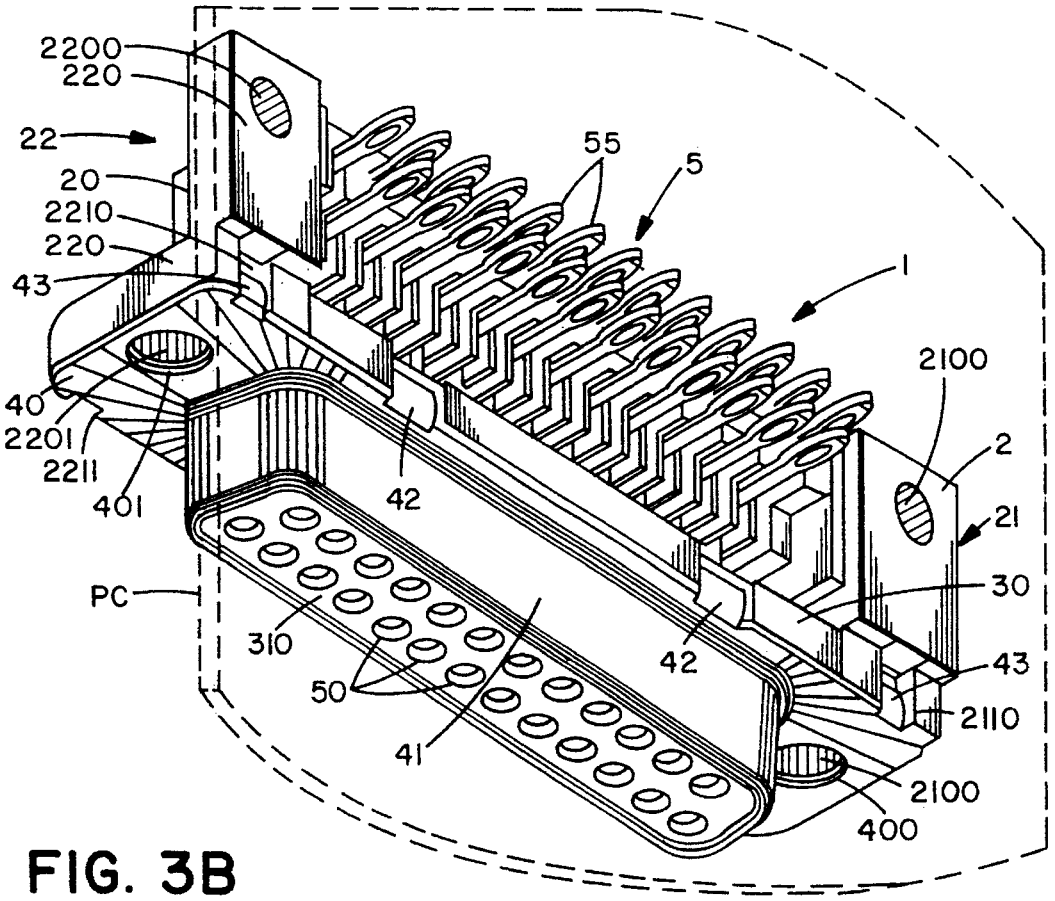

During a final assembly operation, more particularly illustrated by FIGS. 3*a* and 3*b*, rear insulating block 2 is positioned above front insulating block 3, contact elements 5, elbow parts 53 and terminations 54–54'; which are slid into their respective lodgings 201–202 (see FIG. 1).

It only remains to push tabs 43 down into grooves 2210, 2211 and 2110 (the fourth groove not being visible in these figures).

Finally, once the complete assembly is realized, coupling connector 1 according to the invention will be mounted on a printed circuit board PC, represented in FIG. 3*b* by the dashed line. To do this, terminations 55 of contact elements 5 are forcefully inserted into the holes pierced (not shown) in printed circuit board PC, in the same arrangement as that adopted for the rows of contact elements 5.

Part 211 of wing 21, designed to be contacted with printed circuit PC is also visible in this figure, as well as opening 2111 pierced in the latter.

Coupling connector 1 is definitively attached onto printed circuit board PC by means of openings 2211 and 2111. Corresponding openings (not shown) are made in printed circuit board PC. Attachment is obtained, classically, by means of screws, rivets or similar components.

The arrangements, adopted within the scope of the invention, advantageously permit integrating rear insulating block 2, and accessory attachment wings 221 and 211. These wings are furnished with openings 2200 and 2100 which correspond to openings 400 and 401 made in support 40 of front box 4. In a variant, which is not illustrated, one can provide these openings as female screws designed to receive the associated screws, for example, of connectors belonging to coupling connector 1. In the example illustrated, these will be connectors with male contacts.

It should be clear that the invention is not limited to only the examples of embodiment described above, notably in relation to FIGS. 1 to 3*b*.

As has already been indicated, the type of contacts can be either female (example described) or male. The forms and configurations of the different elements constituting the coupling connector according to the invention can be adapted, as need be, for various applications without exceeding the scope of the invention. In particular, the number of contact rows (two in the example described) is not critical. It can range from a single row to a maximum number determined only by technological considerations within the scope of the expert's knowledge.

Although particularly interesting, because this device reinforces the solidity of the structure in its assembly, it is not absolutely necessary for the front box to be of one piece with the front insulating block. In fact, since the structure is of the sandwich type, it is sufficient that the rear insulating block be joined to the front box, according to an essential characteristic of the invention.

Finally, although in the example illustrated we have given the front box an asymmetrical form, which permits it to play the role of a corrector in addition to its essential shielding function, it is clear that an entirely symmetrical form can also be adopted.

The technical characteristics that have just been reported: number of contacts, arrangement of contacts, dimensions, etc., are moreover most often imposed by norms or standards, except for the manufacture of specific components.

What is claimed is:

1. Coupling connector (1) of the type comprising a front insulating block (3); elbow electrical contact elements (5) having front contact regions (50) lodged in openings (300) made in said front insulating block (3) as well as regions forming elbows (51) and rear contact terminations (54, 54', 55); a rear insulating block (2), said rear insulating block (2) having a central region (20) and two lateral branches (21, 22); and a front box (4), characterized in that said front insulating block, said rear insulating block and said front box are separate elements and said front box includes a central opening for receiving a portion of said front insulating block therein and at least said front box (4) and rear insulating block (2) are furnished with complementary attachment means (43, 2201, 2210, 2110) so that said rear insulating block and said front box can be joined by a crimping operation with the front insulating block secured therebetween.

2. Coupling connector (1) according to claim 1, further characterized in that said complementary attachment means are made up, on the one hand, of tabs (43) arranged peripherally on front box (4), and on the other hand, by anchoring grooves (2201, 2200, 2110) arranged peripherally on said two lateral branches (21, 22) of said rear insulating block (2).

3. Coupling connector (1) according to claim 1, further characterized in that said front box (4) and said front insulating block (3) are also furnished with complementary attachment means (42, 301) so as to be able to join them by a crimping operation.

4. Coupling connector (1) according to claim 3, further characterized in that said complementary attachment means are made up, on the one hand, of tabs (42) positioned peripherally on front box (4), and on the other hand, by anchoring grooves (301) positioned peripherally on said central region (30) of rear insulating block (2).

5. Coupling connector (1) according to claim 1, further characterized in that said two lateral branches (21, 22) are provided with means (2200, 2100) permitting mechanical coupling of specified accessories to said coupling connector (1).

6. Coupling connector (1) according to claim 5, further characterized in that said means comprise openings (2200, 2110) hollowed out in said two lateral branches (21, 22).

7. Coupling connector (1) according to claim 1, further characterized in that said contacts (5) are of the female type.

8. Coupling connector (1) according to claim 1, further characterized in that said contacts (5) are of the male type.

9. Coupling connector (1) according to claim 1, further characterized in that it has several parallel rows of contacts (5).

10. Coupling connector (1) of the type comprising a front insulating block (3); elbow electrical contact elements (5) having front contact regions (50) lodged in openings (300) made in said front insulating block (3) as well as regions forming elbows (51) and rear contact terminations (54, 54', 55); a rear insulating block (2), said rear insulating block (2) having a central region (20) and two lateral branches (21, 22); and a front box (4), characterized in that at least said front box (4) and rear insulating block (2) are furnished with complementary attachment means (43, 2201, 2210, 2110) so that they can be joined by a crimping operation, and wherein said front box (4) and said front insulating block (3) are also furnished with complementary attachment means (42, 301) so as to be able to join them by a crimping operation.

* * * * *